US005947185A

United States Patent [19]

Oda et al.

[11] Patent Number: 5,947,185

[45] Date of Patent: Sep. 7, 1999

[54] METHOD AND APPARATUS FOR PRE-COMPACTING MOLDING SAND

[75] Inventors: Shigeo Oda, Toyokawa; Kimikazu Kaneto, Toyohashi; Ryoji Kanayama, Toyohashi; Kuniyasu Mori; Kazuo Sugimoto, both of Toyokawa, all of Japan

[73] Assignee: Sintokogio, Ltd., Nagoya, Japan

[21] Appl. No.: 09/046,276

[22] Filed: Mar. 23, 1998

[30] Foreign Application Priority Data

Mar. 28, 1997 [JP] Japan ..... 9-095216
May 23, 1997 [JP] Japan ..... 9-150247

[51] Int. Cl.[6] ..... B22D 46/00; B22C 15/02

[52] U.S. Cl. ..... 164/456; 164/37; 164/172; 164/169

[58] Field of Search ..... 164/37, 38, 195, 164/207, 456, 4.1, 169, 150.1, 151, 172

[56] References Cited

U.S. PATENT DOCUMENTS 4,262,730 4/1981 Powers ..... 164/4
5,332,025 7/1994 Larsen ..... 184/456
5,348,070 9/1994 Fischer et al. ..... 163/38
5,558,148 9/1996 Uzaki et al. ..... 164/7.1
5,660,221 8/1997 Oda et al. ..... 164/37
5,791,398 8/1998 Oda et al. ..... 164/207

FOREIGN PATENT DOCUMENTS 9-10892 1/1997 Japan .
9-1288 1/1997 Japan ..... 164/37
9-095216 3/1997 Japan ..... 164/38
9-150247 5/1997 Japan ..... 164/38
2014942 6/1994 Russian Federation ..... 164/151.2

*Primary Examiner*—Patrick Ryan
*Assistant Examiner*—Anjan Dey
*Attorney, Agent, or Firm*—Limbach & Limbach L.L.P.

[57] ABSTRACT

Molding sand filled in a space defined by a pattern plate and a flask is pre-compacted before the molding sand is completely pressed. A pre-compacting member is inserted into the molding sand toward the pattern plate, and then is stopped based on a predetermined depth of the pre-compacting member in the molding sand or a predetermined pressure caused by the pre-compacting member in the molding sand.

16 Claims, 7 Drawing Sheets

METHOD AND APPARATUS FOR PRE-COMPACTING MOLDING SAND

FIELD OF INVENTION

This invention relates to a method and an apparatus for pre-compacting molding sand filled in a space defined by a pattern plate and a flask, especially at parts near the inner and outer surfaces of the patterns, and near the inner surface of the flask, before the molding sand is completely pressed in the flask.

PRIOR ART

Japanese Patent Laid-open No. Hei 9-10892, which was assigned to the applicant of this application, discloses a method and an apparatus for producing a mold. In this method and apparatus, to pre-compact the molding sand near the inner and outer surfaces of patterns, thin-plate bodies are inserted in the molding sand with a certain pressing force.

Also, Japanese Patent Laid-open No. Hei 9-1288, which was also assigned to the applicant of this application, discloses a method and an apparatus that are similar to those in the Japanese patent laid-open publication. But, in this method and apparatus, to pre-compact the molding sand near the inner surface of a flask, cylindrical bodies are inserted into the molding sand slightly spaced apart from the inner surface of the flask. Each of the cylindrical bodies is formed by bending a thin plate, and each has a smaller diameter than the diameter from one side of the inner surface of the flask to the other side.

When tall patterns are used, deep and narrow spaces are formed between the surfaces of the patterns, and between the outer surfaces of the patterns and the inner surface of the flask. Since the deep and narrow spaces are filled with molding sand, it is not free to laterally move in the spaces. As a result, when the thin plates are inserted into the deep and narrow spaces, the molding sand is compacted so that it has a high density in the spaces. Also, when the cylindrical bodies are inserted into the narrow and deep spaces formed between the outer surfaces of the pattern and the inner surface of the flask, similarly, the molding sand is also compacted so that it has a high density in the spaces. This causes the pattern plate to be deformed or cracked, when its material, such as wood, is relatively weak.

When low patterns are used, no deep and narrow space is formed on the pattern plate. Thus, the molding sand can be free to move on the upper surface of the pattern plate. However, when the cylindrical bodies are inserted into the molding sand on the upper surface of the pattern plate, the cylindrical bodies extrude the molding sand on the upper surface of the pattern plate. This results in collisions of the lower ends of the cylindrical bodies against the upper surface of the pattern plate, so that the pattern plate is damaged.

This invention is conceived in view of the above prior-art drawbacks. This invention aims to provide a method and an apparatus for pre-compacting molding sand without damaging a pattern plate.

SUMMARY OF THE INVENTION

In one aspect of this invention a method for pre-compacting molding sand filled in a space defined by a pattern plate and a flask before the molding sand is completely pressed comprises the steps of inserting a pre-compacting member into the molding sand toward the pattern plate, and stopping the movement of the pre-compacting member based on a predetermined value.

In another aspect, an apparatus is provided for pre-compacting molding sand filled in a space defined by a pattern plate and a flask at parts near the inner surface of the flask before the molding sand is completely pressed. The apparatus comprises a table on which the pattern plate is attached, a cylindrical body that is to be inserted into the molding sand, said cylindrical body being smaller than the flask, so that the cylindrical body can be positioned slightly spaced apart from the inner surface of the flask, means for moving either the table or the cylindrical body, a displacement sensor for measuring the displacement between the table and the cylindrical body when the cylindrical body is inserted into the molding sand, and a controller connected to the displacement sensor for generating a signal to stop both the table and the cylindrical body from moving when the relative displacement corresponds to a predetermined depth of the cylindrical body in the molding sand.

DETAILED DESCRIPTION OF THE PREFERRED EMBODIMENT

Figure 1:
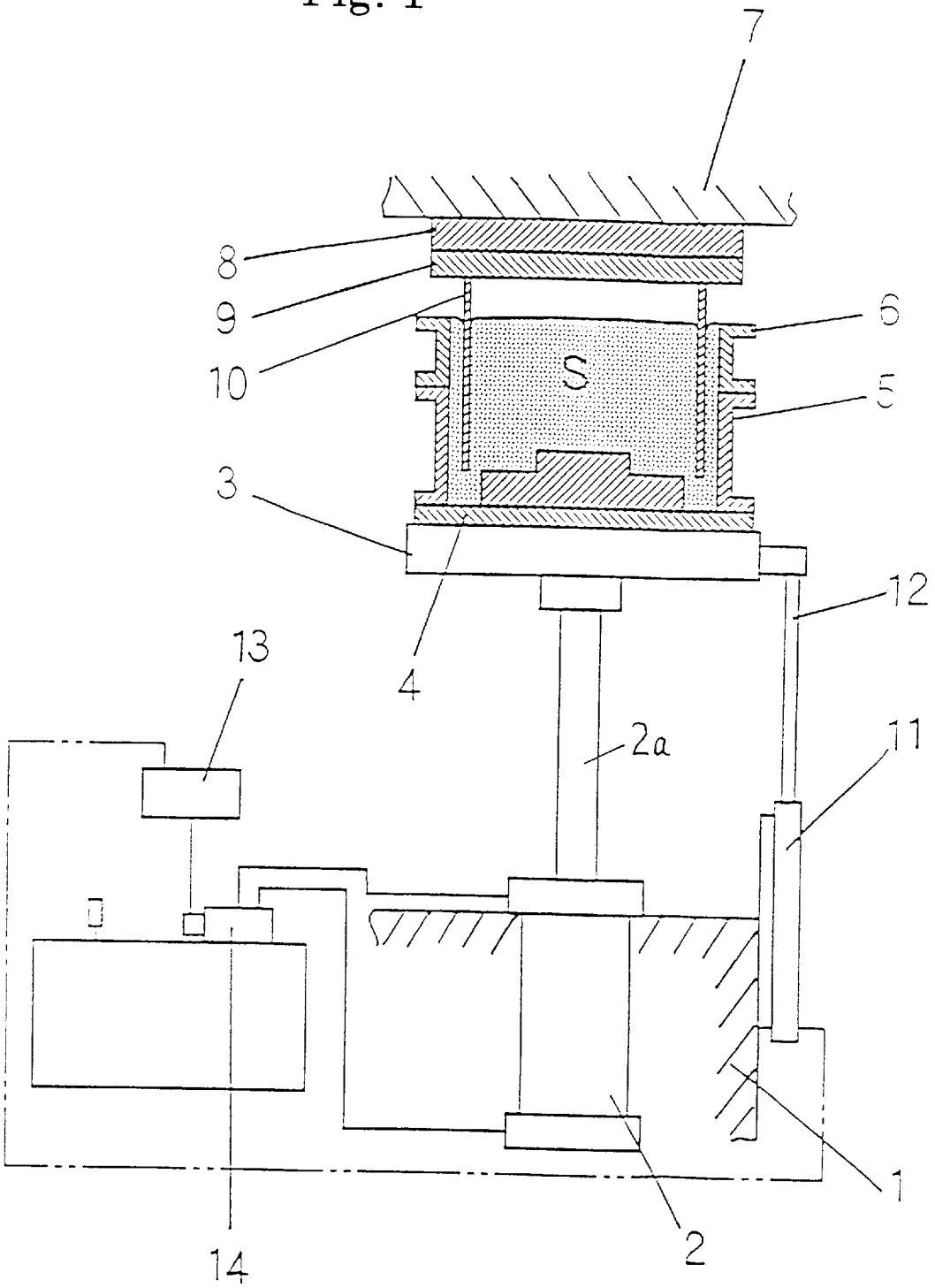
FIG. 1 is a partly cross-sectional front view of an embodiment of the molding machine of this invention.

The preferred embodiments of this invention will now be explained by reference to the accompanying drawings. FIG. 1 shows an embodiment of a molding machine. As in FIG. 1, an upwardly-facing oil cylinder 2 is fixed in a base 1. A table 3 acts as a lifter, and is secured to a top end of a piston rod 2*a*. A pattern plate 4, on which a pattern is attached, is fixed on the upper surface of the table 3. A flask 5 is mounted on the pattern plate 4. A filling frame 6 is in turn mounted on the flask 5. The pattern plate 4, the flask 5, and the filling frame 6 define a space therein. The space is filled with molding sand S.

There is a frame 7 above the table 3. A cylindrical body 10 is a pre-compacting member. It is secured to the lower surface of the frame 7 through a base 8 and a fixing plate 9, and thus it is projected downward. The cylindrical body 10 is formed by bending a thin plate. The cylindrical body 10 has a slightly smaller diameter than the flask 5, so that it can be inserted into the molding sand S and slightly spaced apart from the inner surface of the flask 5.

Also, a sensor 11 is mounted on the side of the base 1 so as to measure the depths of the cylindrical body 10 in the molding sand S as it is being inserted into the molding sand S. The sensor 11 has a rod 12, which can slide in it. The upper end of the rod 12 is attached to the side end of the table 3, so that the table 3 pulls up the rod 12 as it is lifted by the piston rod 2*a*. As the rod 12 is pulled up, the sensor 11 generates electrical signals indicating displacements between the table 3 and the base 1 when the table 3 is lifted. The sensor 11 is electrically connected to a valve system 14 to control the cylinder 2 through a controller 13.

As the piston rod 2*a* extends, the cylindrical body 10 is being inserted into the molding sand S. When the table 3 pulls up the rod 12, the sensor 11 generates signals indicating displacements between the table 3 and the base 1, and transmits the signals to the controller 13. The displacements correspond to the depths of the cylindrical body 10 in the molding sand S when it is inserted into it. When the displacement reaches a predetermined value, the sensor 11 generates a signal indicating that the lower end of the cylindrical body 10 has reached the predetermined depth. Then, the sensor 11 transmits the signal to the valve system 14. It stops the piston rod 2*a* from being further extended. The predetermined value is determined based on the shapes of the patterns on the pattern plate, e.g., a width, a height, and a depth, of each pattern. So that the cylindrical body 10 may not damage any pattern plate, how deep the cylindrical body 10 can be inserted into the molding sand S is determined based on many studies for a pattern. Thus, when the cylindrical body 10 is inserted into the molding sand to a predetermined depth, the cylindrical body does not damage any pattern plate. Data indicating a predetermined depth in the molding sand for a related pattern is previously stored in the controller 13.

In operation, data indicating the predetermined depth in the molding sand for the pattern as in FIG. 1 is previously stored in the controller 13. Then, the flask 5 and the frame 6 are mounted on the pattern plate 4. A space is defined by the pattern plate 4, the flask 5, and the frame 6, and filled with molding sand S. Then, the cylinder 2 is operated to extend the piston rod 2*a*, so that the table 3, the pattern plate 4, the flask 5, and the frame 6, are lifted. As the table 3 etc. are lifted, the cylindrical body 10 is being inserted into the molding sand S, and the sensor 11 outputs signals indicating displacements between the table 3 and the base 1, i.e., the depths of the cylindrical body 10 in the molding sand S. The signals are transmitted to the controller 13. When the end of the cylindrical body 10 reaches the predetermined depth, the controller 13 generates a signal and transmits it to the valve system 14 to stop the piston rod 2*a* from being further extended, as in FIG. 1. At this time the pre-compaction of the molding sand is finished.

Then, the cylinder 2 retracts the piston rod 2*a*, so that the cylindrical body 10 is withdrawn from the molding sand S. Thereafter, a pressing apparatus (not shown) and the cylinder 2 operate to completely compress the molding sand, so that a mold is produced.

Figure 2:
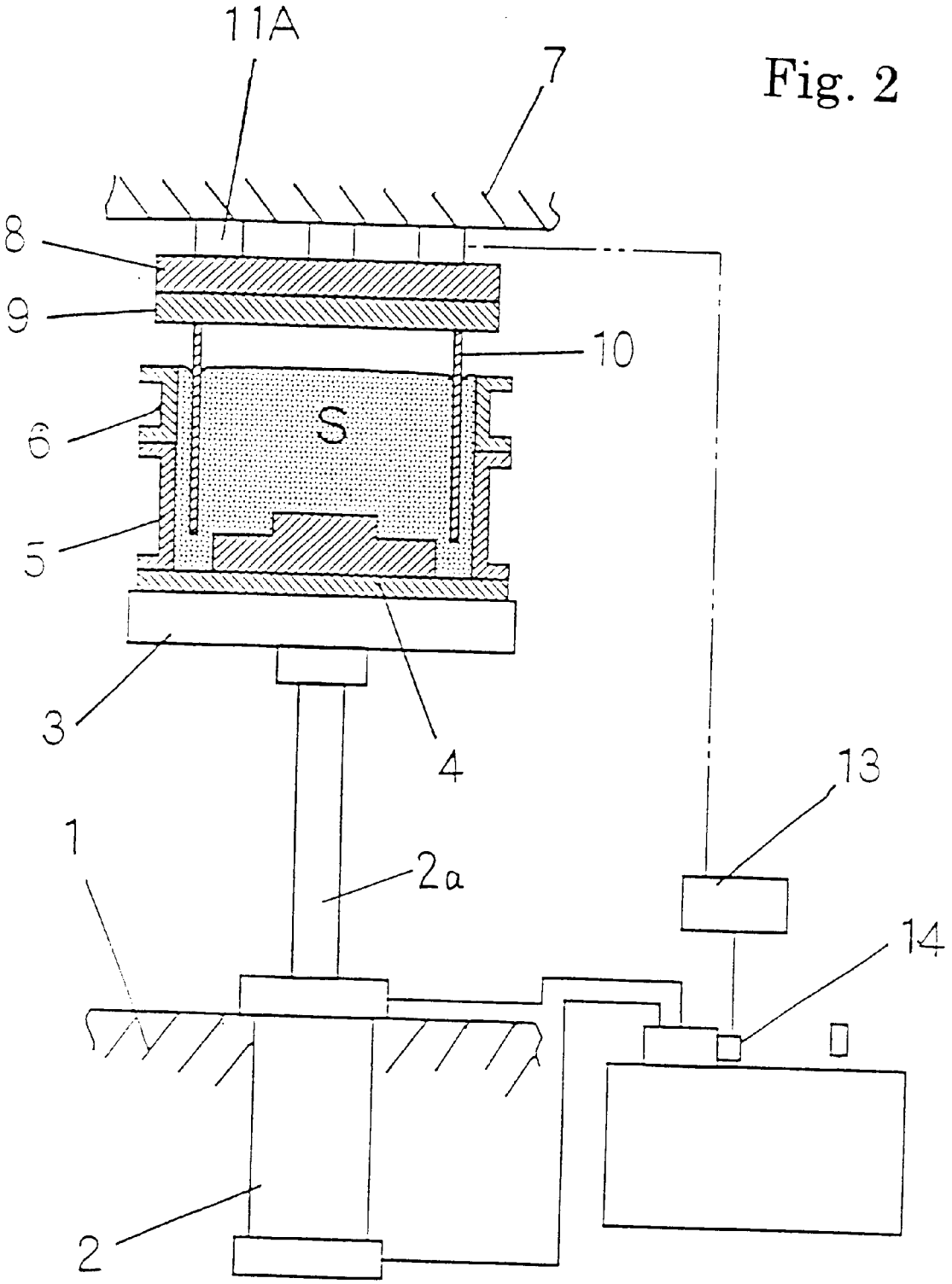
FIG. 2 is a partly cross-sectional front view of a second embodiment of the molding machine of this invention.

FIG. 2 shows a second embodiment of the molding machine of this invention. This molding machine is the same as that in FIG. 1 except that the base 8 and the fixing plate 9 are attached to the frame 7 through a pressure sensor 11A, and that the sensor 11 and the rod 12 are not used. The pressure sensor 11*a* is electrically connected to the controller 13. The pressure sensor 11A measures pressures from the cylindrical body 10 on the molding sand S when it is inserted into it. As the cylindrical body 10 is deeply inserted into the molding sand S, the pressure increases. If the pressure is over a critical value, the pattern plate is damaged. The critical values differ for different patterns. The critical pressures are predetermined by many studies for patterns, so that the cylindrical body 10 may not create an excessive pressure on the pattern plate directly or through the molding sand S.

When the pressure sensor 11A supplies a signal indicating a critical value to the controller 13, the controller 13 generates a signal and transmits it to the valve system 14 to stop the piston rod 2*a* from further extending.

In operation, data on the critical pressure for the pattern in FIG. 2 is predetermined in the controller 13. Like the case as in FIG. 1, the cylinder 2 is operated to extend the piston rod 2*a* to pre-compress the molding sand S with the cylindrical body 10. When the pressure sensor 11A generates a signal indicating the critical pressure from the cylindrical body 10 on the molding sand has been reached, the controller 13 generates a signal and transmits it to the valve system 14 to stop the piston rod 2*a*from further extending. At this time the pre-compaction of the molding sand is finished.

Then, the cylinder 2 retracts the piston rod 2*a*, so that the cylindrical body 10 is withdrawn from the molding sand S. Thereafter, a pressing apparatus (not shown) and the cylinder 2 operate together to completely compress the molding sand, so that a mold is produced.

Figure 3:
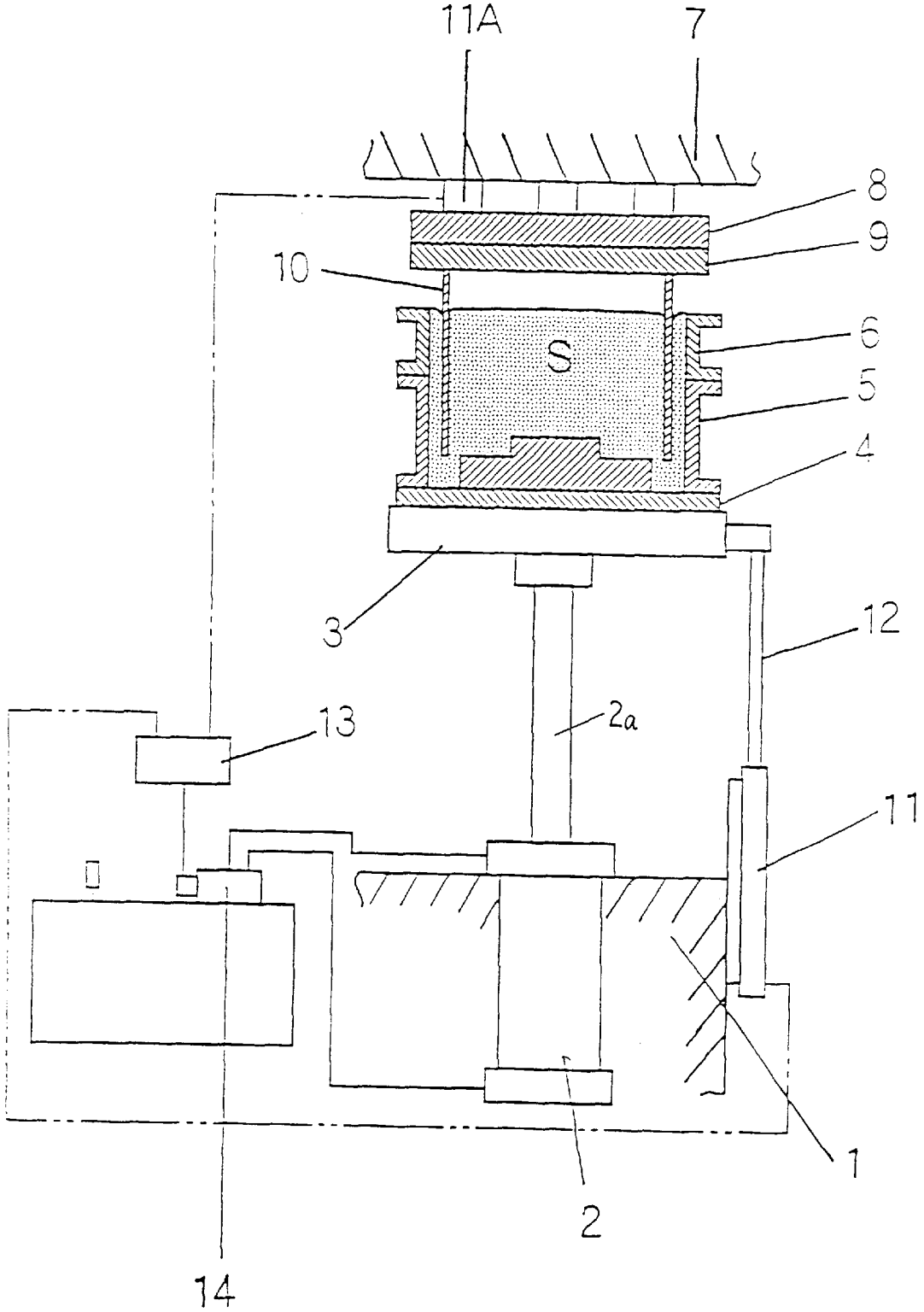
FIG. 3 is a partly cross-sectional front view of a third embodiment of the molding machine of this invention.

FIG. 3 shows a third embodiment of the molding machine of this invention. This molding machine uses the sensor 11 to sense the displacements of the table 3 and the pressure sensor 11A to sense the pressure from the cylindrical body 10 on the molding sand. The sensors 11 and 11A are connected to the controller 13. Data indicating the predetermined depth and the critical pressure for the pattern as in FIG. 3 is previously stored in the controller 13. When the controller 13 receives a signal on data from one of the sensors, the controller 13 sends a signal to the valve system 14 to stop the piston rod 2*a* from further extending.

Thus, the molding machine in FIG. 3 can stop the piston rod 2*a* from being further extended based on either the depth of, or pressure from, the cylindrical body, when the molding sand is pre-compacted.

Figure 4:
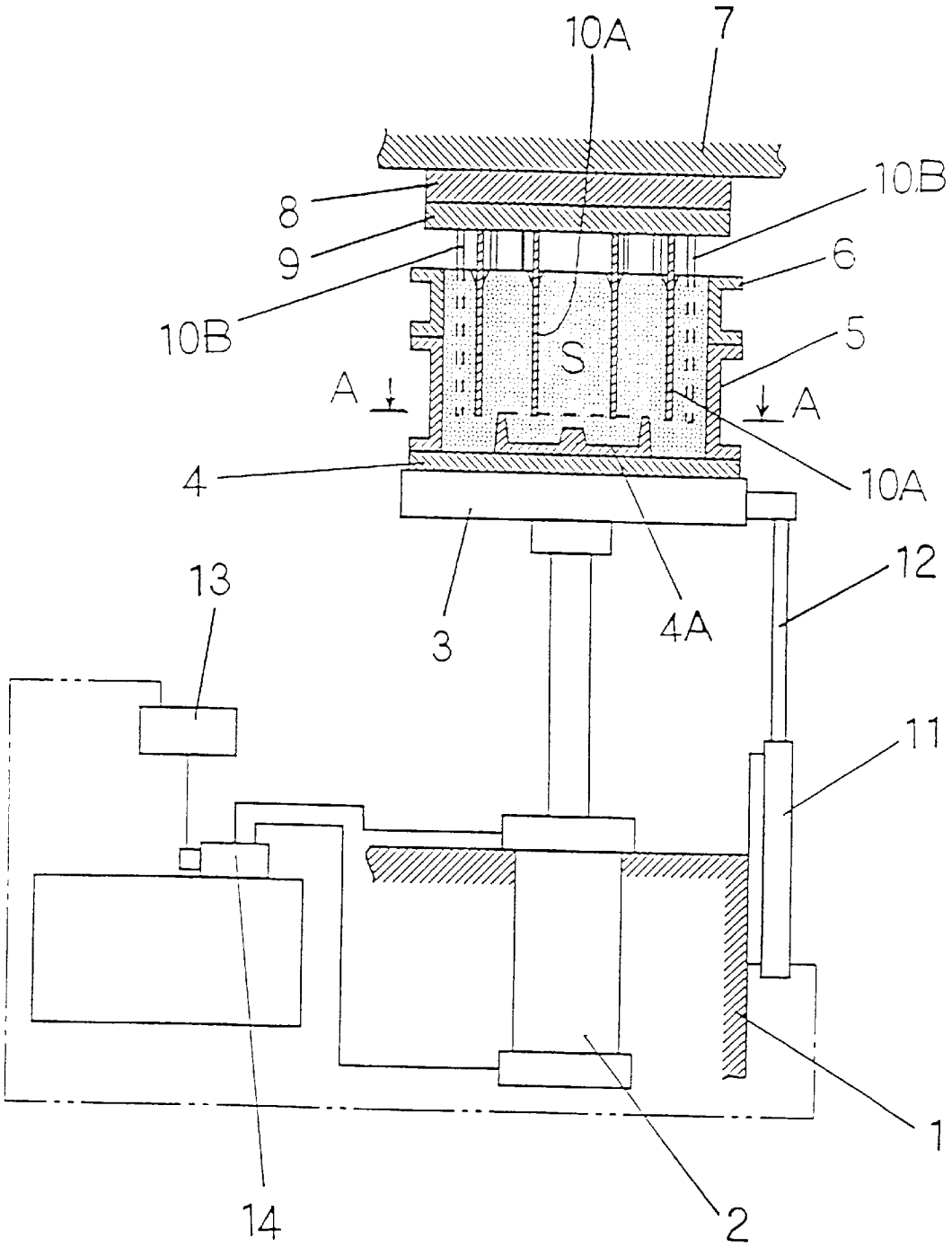
FIG. 4 is a partly cross-sectional front view of a fourth embodiment of the molding machine of this invention.

FIG. 4 shows a fourth embodiment of the molding machine of this invention. This embodiment is the same as that in FIG. 1 except that, instead of the cylindrical body 10 in FIG. 1, in FIG. 4 a thin-plate assembly 10' is used for a pre-compacting member. It is secured to the lower surface of the frame 7 through the base 8 and the fixing plate 9, and projected downward. The thin-plate assembly 10' consists of thin plates 10A and L-like plates 10B. The thin-plates 10A are to be inserted into the molding sand S at parts between projecting parts of the pattern 4A, and near the outer surface of the pattern 4A. The L-like plates 10B are to be inserted into the molding sand S at parts near the inner surface of the flask 5.

Figure 5:
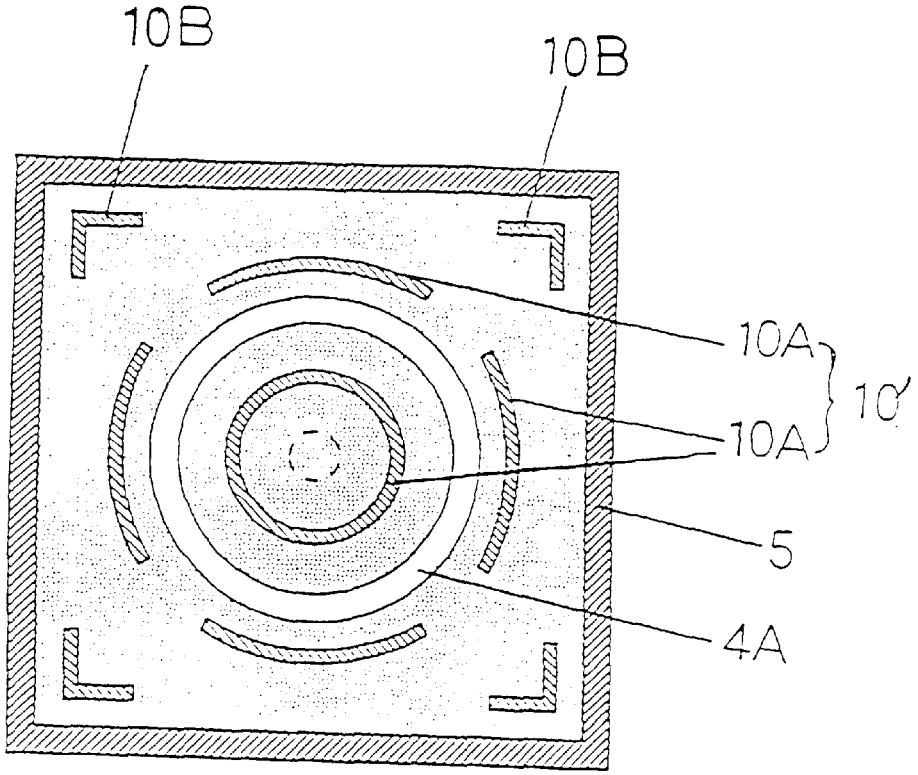
FIG. 5 is a cross-sectional view along line A—A in FIG. 4.

FIG. 5 shows a cross-sectional view along line A—A in FIG. 4. As in this figure, a circular surface of the top end of the projecting part of the pattern 4A can be seen. Anther projecting part is shown by a broken line at the center of the pattern. The L-like plates 10B are put at the corners of the flask 5. The four thin-plates 10A are put near the outer surface of the outer projecting part of the pattern 4A. Also, a cylindrical member 10A surrounds the central projecting part of the pattern 4A. The four thin-plates 10A may be formed to be a cylindrical member.

Figure 6:
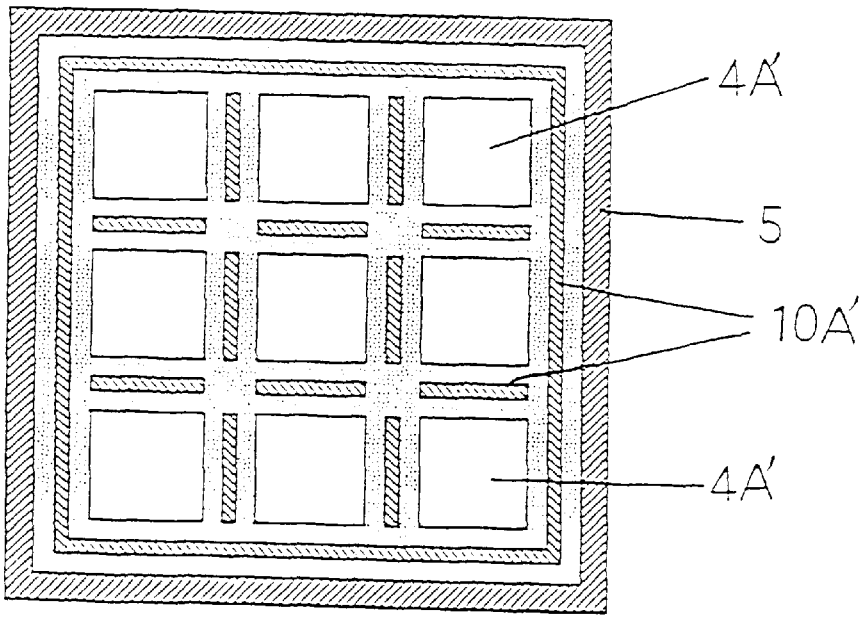
FIG. 6 is a cross-sectional view similar to FIG. 5 to show another embodiment, of thin-plate bodies.

FIG. 6 shows another embodiment, of patterns 4A'. They include nine patterns 4A'. In this case, a square body that is connected by thin-plates 10A' surrounds the nine patterns 4A' within the flask 5. Thin-plates 10A' are put between any adjacent patterns 4A'. According to the shapes of a pattern, a plate with any corresponding shape can be used for a pre-compacting member.

Again referring to FIG. 4, like the molding machine in FIG. 1, the sensor 11 is mounted on the side of the base 1 to measure displacements between the table 3 and the base 1 when the table 3 is lifted. When the rod 12 is pulled up, the sensor 11 generates electrical signals indicating the displacements. The sensor 11 is electrically connected to the valve system 14 to control the cylinder 2 through the controller 13.

When the piston rod 2*a* extends, the table 3 is lifted, and thus the thin plates 10A and the L-like plates 10B are inserted into the molding sand S.

When the table 3 pulls up the rod 12, the sensor 11 generates signals indicating the displacements, and transmits them to the controller 13. The displacements correspond to the depths of the thin plates 10A in the molding sand S at parts between the patterns. When the lower ends of the thin plates 10A reach a predetermined depth, the sensor 11 transmits a signal indicating the predetermined depth to the valve system 14, so that it stops the piston rod 2*a* from further extending. The predetermined depth is determined based on shapes of patterns on the pattern plate, e.g., a width, a height, and a depth, of the patterns. So that the thin plates 10A may not damage the pattern plate, how deep the thin plates 10A can be inserted into the molding sand S is determined by many studies for patterns. Thus, if the thin plates 10A are inserted into the molding sand to a predetermined depth, the thin plates 10A and the L-like plates 10B do not damage the pattern plate. Data on a predetermined depth in the molding sand for a related pattern is stored in the controller 13.

In operation, data on the predetermined depth in the molding sand for the pattern 4A as in FIG. 4 is previously stored in the controller 13. Then, the flask 5 and the frame 6 are mounted on the pattern plate 4. A space is defined by the pattern plate 4, the flask 5, and the frame 6, and then filled with the molding sand S. Then, the cylinder 2 is operated to extend the piston rod 2*a*, so that the table 3, the pattern plate 4, the flask 5, and the frame 6, are lifted. As the table 3 etc., are lifted, the thin plates 10A and the L-like plates 10B are inserted into the molding sand S.

As the thin plates 10A and the L-like plates 10B are inserted into the molding sand, the sensor 11 outputs signals indicating displacements between the table 3 and the base 1, i.e., the depths of the thin plates 10A in the molding sand S. When the ends of the thin plates 10A reach the predetermined depth, the controller 13 transmits a signal to the valve system 14 to stop the piston rod 2*a* from further extending, as in FIG. 4. At this time the pre-compaction of the molding sand is finished.

Then, the cylinder 2 retracts the piston rod 2*a*, so that the thin plates 10A and the L-like plates 10B are withdrawn from the molding sand S. Thereafter, a pressing apparatus (not shown) and the cylinder 2 operate to completely compress the molding sand, so that a mold is produced.

Figure 7:
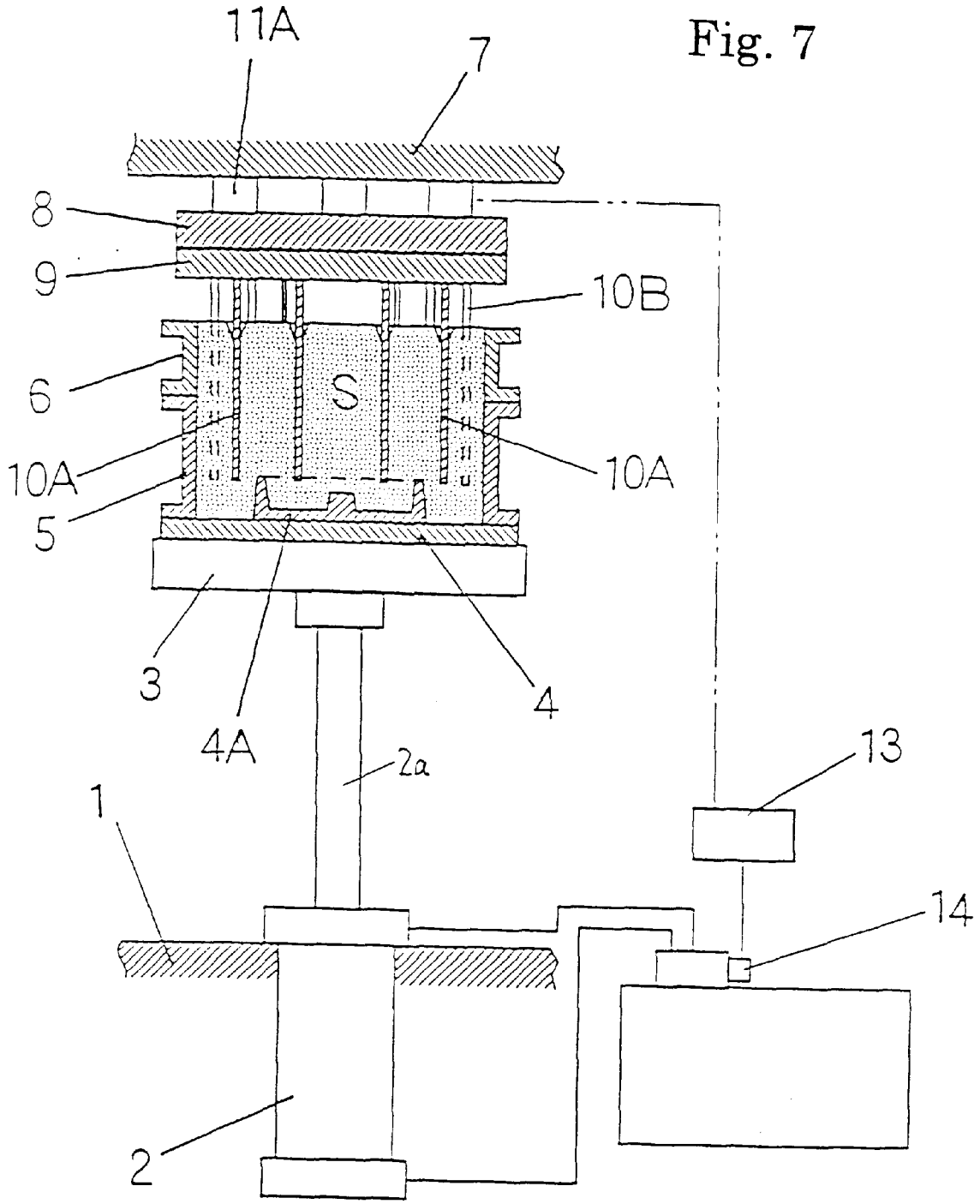
FIG. 7 is a partly cross-sectional front view of a fifth embodiment of the molding machine of this invention.

FIG. 7 shows a fifth embodiment of the molding machine of this invention. This molding machine is the same as that in FIG. 4 except that the base 8 and the fixing plate 9 are attached to the frame 7 through the pressure sensor 11A, and that the sensor 11 and the rod 12 are not used. The pressure sensor 11*a* is electrically connected to the controller 13. The pressure sensor 11A measures the pressure from the thin plates 10A and the L-like plates 10B when they are inserted into the molding sand S. Critical pressures differ for different patterns. The critical pressures are predetermined by many studies for patterns so that the thin plates 10A and the L-like plates 10B may not add an excessive force to the pattern plate directly or through the molding sand S.

When the pressure sensor 11A supplies to the controller 13 a signal indicating that a critical pressure has been reached, it transmits a signal to the valve system 14 to stop the piston rod 2*a* from further extending.

In operation, data on the critical pressure for the patterns 4A in FIG. 7 is predetermined, and stored in the controller 13. Like the case in FIG. 4, the cylinder 2 is operated to extend the piston rod 2*a* to pre-compress the molding sand S with the thin plates 10A and the L-like plates 10B. When the pressure sensor 11A generates a signal indicating the pressure from the thin plates 10A and the L-like plates 10B on the molding sand has caused a critical pressure to be reached, the controller 13 transmits a signal to the valve system 14 to stop the piston rod 2*a* from further extending. At this time the pre-compaction of the molding sand is completed.

Then, the cylinder 2 retracts the piston rod 2*a*, so that the thin plates 10A and the L-like plates 10B are withdrawn from the molding sand S. Thereafter, a pressing apparatus (not shown) and the cylinder 2 operate to completely compress the molding sand, so that a mold is produced.

Figure 8:
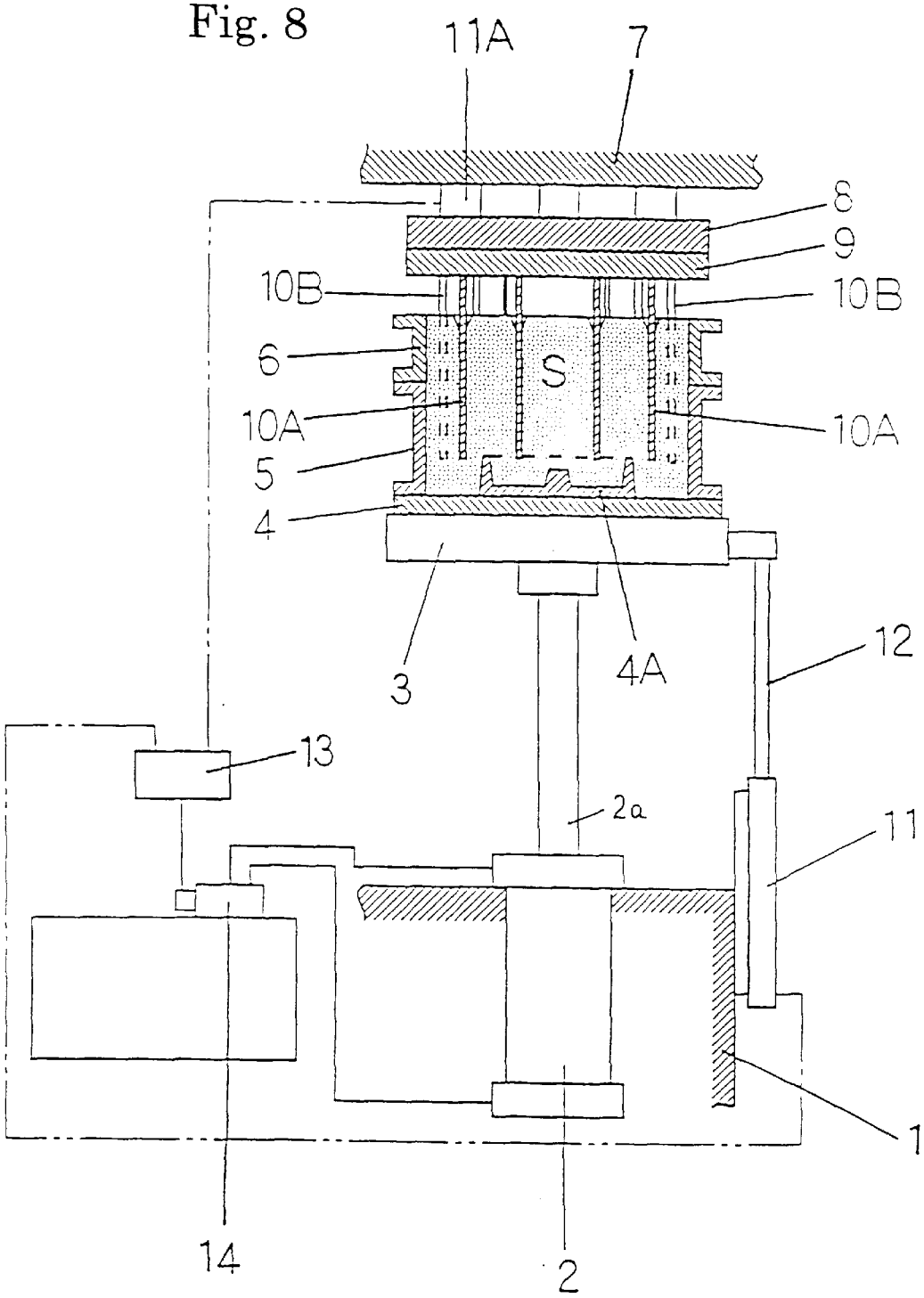
FIG. 8 is a partly cross-sectional front view of a sixth embodiment of the molding machine of this invention.

FIG. 8 shows a sixth embodiment of the molding machine of this invention. This molding machine uses the sensor 11 to sense the depth of the thin plates 10A and the pressure sensor 11A to sense the pressure from the thin-plate assembly 10. The sensors 11 and 11A are connected to the controller 13. Data on a predetermined depth of the thin plates 10A and a predetermined pressure from the thin plates 10A and the L-like plates 10B to the molding sand for the patterns is previously stored in the controller 13. When the controller 13 receives a signal on data from either sensor, the controller 13 transmits a signal to the valve system 14 to stop the piston rod 2*a* from further extending.

Thus, the molding machine in FIG. 8 can stop the piston rod 2*a* from extending based on either the depth of the thin plates 10A or the pressure from the thin plates 10A and the L-like plates 10B, when the molding sand is pre-compacted.

In the above embodiments in FIGS. 1, 2, 3, 4, 7, and 8, the table 3 is lifted relative to the pre-compacting member 10. However, alternatively, the table 3 may be fixed, while the cylindrical body 10 and the pre-compacting member 10 may be moved by a piston cylinder. Also, the sensor 11 in FIGS. 1, 3, 4, and 8 may be fixed to the frame 7, the cylinder may be mounted to move the cylindrical body 10 and the thin-plate assembly 10', and the rod 12 may be attached to the base 8 or the fixing plate 9.

According to this invention, the pattern plate is not damaged even if it is weak, when the molding sand is pre-compacted by a thin-plate assembly etc., because the insertion of the thin-plate assembly etc. is controlled based on the depth that it is inserted, and the pressure from it, when it is inserted in the molding sand.

We claim:

1. A method for pre-compacting molding sand filled in a space defined by a pattern plate and a flask before the molding sand is completely pressed, comprising the steps of:

(a) inserting a pre-compacting member into the molding sand relative to the pattern plate;

(b) while performing step (a), sensing a parameter indicative of at least one of pressure exerted by the pre-compacting member on the molding sand and relative position of the pattern plate and the pre-compacting member, and generating a signal indicative of a value of the parameter being sensed;

(c) determining a threshold value of the parameter, based on at least one characteristic of the pattern plate, such that the parameter will have the threshold value when the pre-compacting member is immersed to a predetermined depth in the sand; and (d) while performing steps (a) and (b), monitoring the signal and stopping the pre-compacting member when the signal is indicative of the threshold value of the parameter.

2. The method of claim 1, wherein the pre-compacting member is inserted into the molding sand at parts near an inner surface of the flask, and wherein the pre-compacting member is a cylindrical body.

3. The method of claim 1, wherein the pattern plate defines patterns, the pre-compacting member is inserted into the molding sand at parts near an inner surface of the flask and near inner and outer surfaces of the patterns, and the pre-compacting member is a thin-plate body.

4. The method of claim 1, wherein the parameter is the pressure exerted by the pre-compacting member on the molding sand.

5. An apparatus for pre-compacting molding sand filled in a space defined by a pattern plate and a flask at parts near the inner surface of the flask before the molding sand is entirely pressed, comprising a table (3) on which the pattern plate is attached, a cylindrical body (10) that is to be inserted into the molding sand (S), said cylindrical body (10) being smaller than the flask so that the cylindrical body can be positioned slightly spaced apart from the inner surface of the flask, means (2) for displacing either the table (3) or the cylindrical body (10), a displacement sensor (11) for measuring a displacement between the table (3) and the cylindrical body (10) when the cylindrical body is inserted into the molding sand (S), and a controller (13) connected to the displacement sensor (11) for generating a signal to stop either the table (3) or the cylindrical body (10) from moving when the displacement corresponds to a predetermined depth of the cylindrical body in the molding sand.

6. The apparatus of claim 5 wherein the displacing means is an oil cylinder (2), and further comprising a valve means (14) connected to the controller (13) for receiving the signal therefrom for controlling the oil cylinder (2).

7. An apparatus for pre-compacting molding sand filled in a space defined by a pattern plate and a flask at parts near the inner surface of the flask before the molding sand is entirely pressed, comprising a table (3) on which the pattern plate is attached, a cylindrical body (10) that is to be inserted into the molding sand (S), said cylindrical body (10) being smaller than the flask so that the cylindrical body can be positioned slightly spaced apart from the inner surface of the flask, means (2) for displacing either the table (3) or the cylindrical body (10), a sensor (11A) for measuring a pressure from the cylindrical body (10) when it is inserted into the molding sand, and a controller (13) connected to the sensor (11A) for generating a signal to stop moving either the table (3) or the cylindrical body (10) when the measured pressure corresponds to a predetermined pressure from the thin-plate body.

8. The apparatus of claim 7 wherein the displacing means is an oil cylinder (2), and further comprising a valve means (14) connected to the controller (13) and receiving the signal therefrom for controlling the oil cylinder (2).

9. An apparatus for pre-compacting molding sand filled in a space defined by a pattern plate and a flask at parts near the inner surface of the flask, before the molding sand is completely compressed, comprising a table (3) on which the pattern plate is attached, a cylindrical body (10) that is to be inserted into the molding sand (S), said cylindrical body (10) being smaller than the flask so that the cylindrical body can be positioned slightly spaced apart from the inner surface of the flask, means (2) for displacing either the table (3) or the cylindrical body (10), a sensor (11) for measuring a displacement between the table (3) and the cylindrical body (10) when the cylindrical body (10) is inserted into the molding sand, a sensor (11A) for measuring a pressure from the thin-plate body (10) when the cylindrical body (10) is inserted into the molding sand, and a controlled (13) connected to the sensors (11) and (11A) for generating a signal to stop either the table (3) or the thin-plate body (10) from moving either when the relative displacement corresponds to a predetermined depth of the cylindrical body in the molding sand or when the pressure corresponds to a predetermined pressure from the thin-plate body.

10. An apparatus of claim 9 wherein the displacing means is an oil cylinder (2), and further comprising a valve means (14) connected to the controller (13), the valve means (14) receiving the signal therefrom for controlling the oil cylinder (2).

11. An apparatus for pre-compacting molding sand filled in a space defined by a pattern plate and a flask at parts near the inner surface of the flask and near the inner and outer surfaces of patterns, before the molding sand is completely pressed, comprising a table (3) on which the pattern plate is attached, a thin-plate body (10) arranged according to the shapes of the patterns, and positioned above the table (3) to be inserted into the molding sand (S), means (2) for moving either the table (3) or the thin-plate body (10), a displacement sensor (11) for measuring a displacement between the table (3) and the thin-plate body (10) when the thin-plate body is inserted into the molding sand (S), and a controller (13) connected to the displacement sensor (11) for generating a signal to stop moving either the table (3) or the thin-plate body (10) when the displacement corresponds to a predetermined depth of the thin-plate body in the molding sand.

12. The apparatus of claim 11 wherein the displacing means is an oil cylinder (2), and further comprising a valve means (14) connected to the controller (13) for receiving the signal therefrom for controlling the oil cylinder (2).

13. An apparatus for pre-compacting molding sand filled in a space defined by a pattern plate and a flask at parts near the inner surface of the flask and near the inner and outer surfaces of patterns, before the molding sand is completely pressed, comprising a table (3) on which the pattern plate is attached, a thin-plate body (10) arranged according to the shapes of the patterns, and positioned above the table (3) to be inserted into the molding sand (S), means (2) for displacing either the table (3) or the thin-plate body (10), a sensor (11A) for measuring a pressure from the thin-plate body (10) when it is inserted into the molding sand, and a controller (13) connected to the sensor (11A) for generating a signal to stop moving either the table (3) or the thin-plate body (10) when the pressure corresponds to a predetermined pressure from the thin-plate body.

14. The apparatus of claim 13 wherein the displacing means is an oil cylinder (2), and further comprising a valve means (14) connected to the controller (13), said valve means (14) receiving the signal therefrom for controlling the oil cylinder (2).

15. An apparatus for pre-compacting molding sand filled in a space defined by a pattern plate and a flask at parts near the inner surface of the flask and near the inner and outer surfaces of patterns, before the molding sand is completely pressed, comprising a table (3) on which the pattern plate is attached, a thin-plate body (10), arranged according to the shapes of the patterns, and positioned above the table (3), to be inserted into the molding sand (S), means (2) for displacing either the table (3) or the thin-plate body (10), a sensor (11) for measuring a displacement between the table (3) and the thin-plate body (10) when the thin-plate body (10) is inserted into the molding sand, a sensor (11A) for measuring a pressure from the thin-plate body (10) when the thin-plate body (10) is inserted into the molding sand, and a controller (13) connected to the sensors (11) and (11A) for generating a signal to stop either the table (3) or the thin-plate body (10) from moving either when the displacement corresponds to a predetermined depth of the thin-plate body in the molding sand or when the pressure corresponds to a predetermined pressure from the thin-plate body.

16. The apparatus of claim 15 wherein the displacing means is an oil cylinder (2), and further comprising a valve means (14) connected to the controller (13), said valve means (14) receiving the signal therefrom for controlling the oil cylinder (2).

* * * * *